US006427485B1

(12) United States Patent
Guillard et al.

(10) Patent No.: US 6,427,485 B1
(45) Date of Patent: Aug. 6, 2002

(54) DEVICE AND METHOD FOR SEPARATING SUBSTANCES BY CRYOGENIC DISTILLATION

(75) Inventors: Alain Guillard, Paris; Bernard Saulnier, Colombes, both of (FR)

(73) Assignee: L'Ari Liquide, Societe Anonyme a Directoire et Conseil de Surveillance pour l'Etude et l'Exploitation des Procedes Georges Claude, Paris (FR)

( * ) Notice: Subject to any disclaimer, the term of this patent is extended or adjusted under 35 U.S.C. 154(b) by 0 days.

(21) Appl. No.: 09/913,185

(22) PCT Filed: Dec. 7, 2000

(86) PCT No.: PCT/FR00/03432

§ 371 (c)(1),
(2), (4) Date: Nov. 30, 2001

(87) PCT Pub. No.: WO01/42726

PCT Pub. Date: Jun. 14, 2001

(30) Foreign Application Priority Data

Dec. 9, 1999 (FR) ..... 99 15557

(51) Int. Cl.[7] ..... F25J 3/02
(52) U.S. Cl. ..... 62/643
(58) Field of Search ..... 62/643, 901, 905

(56) References Cited

U.S. PATENT DOCUMENTS 4,776,900 A 10/1988 Yano et al.

FOREIGN PATENT DOCUMENTS

| | | |
|---|---|---|
| FR | 2 692 663 | 12/1963 |
| FR | 2 676 371 | 11/1992 |
| WO | WO 98/28758 | 7/1998 |
| WO | WO 99/32837 | 7/1999 |

*Primary Examiner*—Denise L. Esquivel
*Assistant Examiner*—Malik N. Drake
(74) *Attorney, Agent, or Firm*—Young & Thompson

(57) ABSTRACT

A separation device which does not produce ultra-pure products. At least one distillation column which has a diameter of at least 4 m and/or is configured for operation at a pressure above 4.5 bar, consists of non-oxidizing steel or steel containing 9 to 10% by weight nickel. The separation device can be an air separation device.

39 Claims, No Drawings

DEVICE AND METHOD FOR SEPARATING SUBSTANCES BY CRYOGENIC DISTILLATION

The present invention relates to an apparatus and process for separation by cryogenic distillation.

Cryogenic distillation is mainly carried out in columns made of aluminum or steel, particularly steel containing nickel or nickel chromium (Tieftemperatur-technik. pages 480 and 482).

It is also known from J 03 204 582 to construct air separation columns made of stainless steel in order to avoid the contamination of ultrapure products.

WO 99/32837 describes a cryogenic distillation column constructed from steel containing less than 9 wt % nickel.

It is necessary to produce ever larger amounts of fluid from the air, such as oxygen, and plants currently under design producing 4000 t/day of high-pressure oxygen are envisaged in the near future.

In the case of aluminum, the thicknesses of the columns become very large, thereby imposing extremely severe manufacturing and control constraints. For a column 6 meters in diameter, operating under a service pressure of 15 bara, with aluminum the thickness of the shell of the column is about 66 mm. using stainless steel, it becomes possible to reduce this thickness to 40 mm.

The pressures involved in this document are absolute pressures.

It is one object of the invention to provide a cryogenic distillation apparatus comprising at least two columns, at least a first column of which, which is that or one of those designed to operate at the highest pressure, has a shell made of stainless steel or steel containing more than 9 and up to 10 wt % nickel, means for sending a mixture to be separated to one of the columns, possibly the first column, and means for withdrawing the fluids, enriched with one component of the mixture, from one of the columns, characterized in that the first column is designed to withstand pressures greater than 4.5 bar and/or in that the diameter of the column is greater than 4 meters.

Preferably, the column(s) designed to operate at the lowest pressure contain(s) less than 80 theoretical trays.

It is another object of the invention to provide a cryogenic distillation apparatus comprising a single column having a shell made of stainless steel or steel containing more than 9 and up to 10 wt % nickel, means for sending a mixture to the column and means for withdrawing fluids, enriched with one component of the mixture, from the column, characterized in that the column is designed to withstand pressures greater than 4.5 bar and/or in that the diameter of the column is greater than 4 meters.

Preferably, the single column contains fewer than 80 theoretical trays.

According to other optional aspects of the abovementioned apparatuses:

- the column designed to operate at the lowest pressure contains fewer than 60 theoretical trays, possibly fewer than 50 theoretical trays or fewer than 40 theoretical trays;
- the apparatus comprises at least one other column with a shell made of aluminum or stainless steel or steel containing more than 9 and up to 10 wt % nickel;
- the diameter of one of the columns having a shell made of stainless steel or steel containing more than 9 and up to 10 wt % nickel is greater than 5 m, possibly greater than 6 m.

It is another aspect of the invention to provide a process for cryogenic distillation in a separation apparatus comprising at least one column, at least the column of which operating at the highest pressure is made of stainless steel or steel containing more than 9 and up to 10 wt % nickel, in which process a mixture is sent to one of the columns where it is separated into fluids enriched with more volatile and less volatile components, characterized in that the column(s) made of stainless steel or steel containing between 8 and 10% nickel operates at at least 4.5 bara and/or has a diameter of at least 4 meters and/or in that the separation apparatus produces, as final product, at least one fluid not containing more than 98 mol % of its main component.

Thus, liquids and gases containing more than 98 mol % of their main component can be produced, but there is at least one impure product (containing less than 98 mol % of its main component).

According to other optional aspects of the invention:

- the separation apparatus is an air separation apparatus which at least produces, as final gaseous products rich in oxygen, fluids not containing more than 98 mol % oxygen, possibly 95 mol % oxygen and possibly 85 mol % oxygen. Liquids richer in oxygen, for example containing at least 99 mol % oxygen, may be produced at the same time;
- the separation apparatus is an air separation apparatus which produces, as final gaseous products rich in oxygen, only fluids not containing more than 98 mol % oxygen, possibly 95 mol % oxygen and possibly 85 mol % oxygen. Liquids richer in oxygen, for example containing at least 99 mol % oxygen, can be produced at the same time;
- the separation apparatus comprises a high-pressure column thermally coupled to at least one low-pressure column and possibly a column operating at a pressure intermediate between the high and low pressures;
- the separation apparatus is an air separation apparatus which at least produces, as final gaseous products rich in nitrogen, fluids containing more than 1 ppm oxygen, possibly 5 ppm oxygen and possibly 10 ppm oxygen. Liquids richer in nitrogen than this gaseous product, for example containing less than 1 ppm oxygen, can be produced at the same time;
- the separation apparatus is an air separation apparatus which produces, as final gaseous products rich in nitrogen, only fluids containing more than 1 ppm oxygen, possibly 5 ppm oxygen and possibly 10 ppm oxygen. Liquids richer in nitrogen than this gaseous product, for example containing less than 1 ppm oxygen, can be produced at the same time;
- the process allows the separation of purified air or a mixture comprising at least 1% nitrogen and/or at least 1% carbon monoxide and/or at least 1% hydrogen and/or at least 1% hydrocarbons;
- the column(s) made of stainless steel or steel containing between 8 and 10% nickel is (are) the high-pressure, intermediate-pressure or low-pressure column of a double column or triple column or the mixing column of an air separation apparatus;
- the column or at least one of the columns made of stainless steel or steel containing more than 9 and up to 10 wt % nickel is a low-pressure column or a mixing column of a double or triple column and the apparatus produces gaseous oxygen, having a maximum purity of 90 mol % and possibly 85 mol % oxygen, withdrawn from the low-pressure column or the mixing column;
- the column or at least one of the columns made of stainless steel or steel containing more than 9 and up to 10 wt % nickel is fed with purified air and/or a mixture enriched with nitrogen and/or oxygen and/or argon;

the column or at least one of the columns made of stainless steel or steel containing more than 9 and up to 10 wt % nickel operates at a pressure above 7.5 bar, possibly above 10 bar, possibly above 12 bar and possibly above 14 bar.

The stainless steel is of the 4307 or 4306 or 304L type and the steel containing between 9 and 10 wt % nickel preferably contains more than 9.2% nickel (type A 353).

Typically, in the case of a stainless steel column shell, for an operating pressure of 5 bara and a diameter of 5 m, according to the ASME code, a stainless steel thickness of around 12 mm is necessary, for an operating pressure of 12 bara and a diameter of 5 m, with the same code, a stainless steel thickness of around 30 mm is necessary and for an operating pressure of 15 bara and a diameter of 5 m a stainless steel thickness of around 40 mm is necessary.

One example of this kind of process will now be described.

In an air distillation apparatus according to the invention, the air separates in a double column comprising a high-pressure column operating at 15 bara and a low-pressure column operating at 5 bara. Each column comprises a stainless steel shell having a diameter of around 5 m. The shell of the high-pressure column has a thickness of 40 mm and the shell of the low-pressure column has a thickness of 12 mm. The low-pressure column contains 40 theoretical trays in the form of structured packings.

The columns contain structured packings made of aluminum or of stainless steel or of steel containing more than 9 and up to 10 wt % nickel or of copper.

The or some of the pipes connecting the columns, for example in order to transfer the rich liquid and the lean liquid from the high-pressure column to the low-pressure column, are made of stainless steel or steel containing more than 9 and up to 10 wt % nickel.

The apparatus produces a stream of gaseous oxygen comprising at most 98 mol % oxygen at the bottom of the low-pressure column. No gas or liquid with a higher oxygen purity is produced by the apparatus.

The apparatus also produces, as gas with the highest nitrogen purity, a stream of gas comprising 98 mol % nitrogen or preferably 95 mol % nitrogen.

Alternatively, in the double column described above the high-pressure column may, for example, have a shell made of stainless steel or steel containing between 8 and 10% nickel and the low-pressure column may have a shell made of aluminum.

The two columns may be placed side by side, as described in French Patent Application No. 2 774 752, and not one on top of the other.

Obviously, the distillation columns operating below 4.5 bar and/or having a diameter below 5 m may have shells made of stainless steel or steel containing 9% nickel with a smaller thickness than with aluminum and can produce final products rich in oxygen, nitrogen or argon.

In a triple column, as described in EP-A-0 538 118 of Ha, there is a high-pressure column, a column operating at a pressure between the high and low pressures and a low-pressure column. All these columns may operate at a pressure above 4.5 bar with a diameter greater than 5 m.

If it is necessary to choose which of the columns will have a shell made of stainless steel or steel containing more than 9 and up to 10 wt % nickel, preferably containing 9.2% nickel, preference will be given to the high-pressure and medium-pressure columns, possibly placing these columns alongside the low-pressure column. Possibly only the high-pressure column or the medium-pressure column will have a shell made of stainless steel or steel containing more than 9 and up to 10 wt % nickel.

Likewise, in a plant comprising a double column and a mixing column operating at a pressure very much higher than the high-pressure column of the double column, the mixing column will be made of stainless steel or steel containing more than 9 and up to 10 wt % nickel, preferably containing 9.5% nickel, and the other columns could be made of steel of the same types.

What is claimed is:

1. A cryogenic distillation apparatus comprising at least two columns, at least a first column of which, which is that or one of those designed to operate at the highest pressure, has a shell made of stainless steel or steel containing more than 9 and up to 10 wt % nickel, means for sending a mixture to be separated to one of the columns, and means for withdrawing the fluids, enriched with one component of the mixture, from one of the columns, wherein the first column has at least one of the following characteristics:

1) it is designed to withstand pressures greater than 4.5 bar 2) the diameter of the column is greater than 4 meters.

2. The apparatus as claimed in claim 1, in which said one of the columns to which the mixture to be separated is sent, is the said first column.

3. The apparatus as claimed in claim 1, in which the column(s) designed to operate at the lowest pressure contain (s) fewer than 80 theoretical trays.

4. The apparatus as claimed in claim 1 in which the column designed to operate at the lowest pressure contains fewer than 60 theoretical trays.

5. The apparatus as claimed in claim 4, in which the column designed to operate at the lowest pressure contains fewer than 50 theoretical trays.

6. The apparatus as claimed in claim 5, in which the column designed to operate at the lowest pressure contains fewer than 40 theoretical trays.

7. The apparatus as claimed in claim 1, comprising at least one other column with a shell made of aluminum or stainless steel or steel containing more than 9 and up to 10 wt % nickel.

8. The apparatus as claimed in claim 1, in which the diameter of one of the columns having a shell made of stainless steel or steel containing more than 9 and up to 10 wt % nickel is greater than 5 m.

9. The apparatus as claimed in claim 8, in which said diameter is greater than 6 m.

10. A cryogenic distillation apparatus comprising a single column having a shell made of stainless steel or steel containing more than 9 and up to 10 wt % nickel, means for sending a mixture to the column and means for withdrawing fluids, enriched with one component of the mixture, from the column, wherein the column has at least one of the following characteristics:

1) it is designed to withstand pressures greater than 4.5 bar 2) the diameter of the column is greater than 4 meters.

11. The apparatus as claimed in claim 10, in which the column contains fewer than 80 theoretical trays.

12. The apparatus as claimed in claim 11, in which the column contains fewer than 60 theoretical trays.

13. The apparatus as claimed in claim 12, in which the column contains fewer than 50 theoretical trays.

14. The apparatus as claimed in claim 13, in which the column contains fewer than 40 theoretical trays.

15. The apparatus as claimed in claim 10, in which the diameter of the column is greater than 5 m.

16. The apparatus as claimed in claim 15, in which the diameter of the column is greater than 6 m.

17. A process for cryogenic distillation in a separation apparatus comprising at least one column, at least the column of which operating at the highest pressure is made of stainless steel or steel containing more than 9 and up to 10 wt % nickel, in which process a mixture is sent to one of the columns where it is separated into fluids enriched with more volatile and less volatile components, which has at least one of the following characteristics:

1) said highest pressure column operates at at least 4.5 bars
2) said highest pressure column has a diameter of at least 4 meters
3) the separation apparatus produces, as final product, at least one fluid not containing more than 98 mol % of its main component.

18. The process as claimed in claim 17, in which the separation apparatus is an air separation apparatus which at least produces, as final gaseous products rich in oxygen, fluids not containing more than 98 mol % oxygen.

19. The process as claimed in claim 18, in which said fluids contain not more than 95 mol % oxygen.

20. The process as claimed in claim 19, in which said fluids contain not more than 85 mol % oxygen.

21. The process as claimed in claim 18, in which the separation apparatus is an air separation apparatus which produces, as final gaseous products rich in oxygen, only fluids not containing more than 98 mol % oxygen.

22. The process as claimed in claim 21, in which said fluids contain not more than 95 mol % oxygen.

23. The process as claimed in claim 22, in which said fluids contain not more than 85 mol % oxygen.

24. The process as claimed in claim 17, in which the separation apparatus comprises a high-pressure column thermally coupled to at least one low-pressure column thermally coupled to at least one low-pressure column.

25. The process as claimed in claim 24, in which said apparatus further comprises a column operating at a pressure intermediate between the high and low pressures.

26. The process as claimed in claim 17, in which the separation apparatus is an air separation apparatus which at least produces, as final gaseous products rich in nitrogen, fluids containing more than 1 ppm oxygen.

27. The process as claimed in claim 26, in which the separation apparatus is an air separation apparatus which at least produces, as final gaseous products rich in nitrogen, fluids containing more than 5 ppm oxygen.

28. The process as claimed in claim 27, in which the separation apparatus is an air separation apparatus which at least produces, as final gaseous products rich in nitrogen, fluids containing more than 10 ppm oxygen.

29. The process as claimed in claim 26, in which the separation apparatus is an air separation apparatus which produces, as final gaseous products rich in nitrogen, only fluids containing more than 1 ppm oxygen.

30. The process as claimed in claim 29, in which the separation apparatus is an air separation apparatus which produces, as final gaseous products rich in nitrogen, only fluids containing more than 5 ppm oxygen.

31. The process as claimed in claim 30, in which the separation apparatus is an air separation apparatus which produces, as final gaseous products rich in nitrogen, only fluids containing more than 10 ppm oxygen.

32. The process for the cryogenic distillation of purified air or a mixture comprising at least one member selected from the group consisting of at least 1% nitrogen, at least 1% carbon monoxide, at least 1% hydrogen and at least 1% hydrocarbons, according to claim 17.

33. The process as claimed in claim 32, in which the column(s) made of stainless steel or steel containing more than 9 and up to 10 wt % nickel is (are) the high-pressure, intermediate-pressure or low-pressure column of a double column or triple column or the mixing column of an air separation apparatus.

34. The process as claimed in claim 33, in which the column made of stainless steel or steel containing more than 9 and up to 10 wt % nickel is a low-pressure column or a mixing column of a double or triple column and the apparatus produces gaseous oxygen, having a maximum purity of 90 mol %, withdrawn from the low-pressure column or the mixing column in at least one of gaseous form and liquid form and subsequently vaporized.

35. The process as claimed in claim 32, in which the column made of stainless steel or steel containing more than 9 and up to 10 wt % nickel is fed with at least one member selected from the group consisting of purified air and a mixture enriched with at least one of nitrogen, oxygen and argon.

36. The process as claimed in claim 17, in which the column made of stainless steel or steel containing more than 9 and up to 10 wt % nickel operates at a pressure above 7.5 bar.

37. The process as claimed in claim 36, in which the column made of stainless steel or steel containing more than 9 and up to 10 wt % nickel operates at a pressure above 10 bar.

38. The process as claimed in claim 37, in which the column made of stainless steel or steel containing more than 9 and up to 10 wt% nickel operates at a pressure above 12 bar.

39. The process as claimed in claim 38, in which the column made of stainless steel or steel containing more than 9 and up to 10 wt % nickel operates at a pressure above 14 bar.

* * * * *